US005100096A

United States Patent [19]

Mizuno et al.

[11] Patent Number: 5,100,096

[45] Date of Patent: Mar. 31, 1992

[54] VIBRATION FREE CONTAINER FOR TRANSPORTATION

[75] Inventors: Keiichiro Mizuno, Tokyo; Kazuyoshi Iida, Yokohama, both of Japan

[73] Assignee: Bridgestone Corporation, Tokyo, Japan

[21] Appl. No.: 378,112

[22] Filed: Jul. 7, 1989

Related U.S. Application Data

[62] Division of Ser. No. 182,706, Apr. 18, 1988, Pat. No. 4,877,136.

[30] Foreign Application Priority Data

Apr. 17, 1987 [JP] Japan ..... 62-93295
May 1, 1987 [JP] Japan ..... 62-106249

[51] Int. Cl.[5] ..... F16F 1/36

[52] U.S. Cl. ..... 248/638; 248/559; 248/630; 248/621

[58] Field of Search ..... 248/638, 632, 562, 630, 248/636, 346, 621, 559; 267/141.1, 294, 153; 108/151.1

[56] References Cited

U.S. PATENT DOCUMENTS 3,201,109 8/1965 Sweeney et al. ..... 248/632 X
4,402,483 9/1983 Kurabayashi et al. ..... 248/638 X
4,688,777 8/1987 Mekosh, Jr. ..... 267/141.1
4,699,180 10/1987 Stefan et al. ..... 248/638 X

FOREIGN PATENT DOCUMENTS 2232102 4/1979 Fed. Rep. of Germany ..... 248/621
806357 12/1936 France ..... 267/294
134269 10/1979 Japan ..... 248/638
99538 6/1983 Japan ..... 248/621
123031 9/1986 Japan ..... 248/632

*Primary Examiner*—Alvin C. Chin-Shue
*Attorney, Agent, or Firm*—Sughrue, Mion, Zinn, Macpeak & Seas

[57] ABSTRACT

A vibration free container for transportation comprises vibration isolating device which are arranged under the container and comprises a lower layer and an upper layer. The lower layer consists of at least two long laminated rubber bodies in the form of a parallelepiped extending in parallel with each other and upper layer consists of a plurality of column-shaped vibration isolators fixed between a bottom plate of the container and upper surfaces of the laminated rubber bodies. Each of the laminated rubber bodies comprises rubber layers and metal plates alternately laminated. In another aspect the vibration free container comprises an outer casing and an inner casing received in the outer casing, and the vibration insulating device is interposed between the outer and inner casing to support the inner casing relative to the outer casing.

7 Claims, 7 Drawing Sheets

VIBRATION FREE CONTAINER FOR TRANSPORTATION

This is a division of application Ser. No. 07/182,706, filed Apr. 18, 1988, U.S. Pat. No. 4,877,136, issued Oct. 30

BACKGROUND OF THE INVENTION

This invention relates to a vibration free container for the transportation of goods.

With hitherto containers used for transportation, after goods to be transported are packaged by buffer materials as urethane, the packed goods are accommodated in the containers and transported. In case of large goods, individual goods are received in wood frames or exclusive wood boxes manually made to meet their sizes. In this manner, effort has been made to absorb vibrations and shocks in transportation.

In case of goods which are not very large, blocks of formed styrol are interposed between the goods in a corrugated card-board box for transportation.

However, the methods of packaging the goods for absorbing the vibrations and shocks above described involve very troublesome and time-consuming operations.

Moreover, the packages according to the hitherto used methods absorb vibrations and shocks in transportation only to a limited extent and are likely to go into resonance with vibrations of certain frequencies. In handling precise machines and instruments, particularly, vibrations and shocks which are not absorbed are liable to cause serious damage to various parts of the machines and instruments.

Furthermore, packed configurations of goods to be transported are different. Such a variety of packages are arranged sufficiently spaced apart from one another on a large truck for transportation in order to avoid any interference with one another. Moreover, it is quite impossible to stack such a variety of packages one upon the other to save the space on the truck. Therefore, a space above a loading platform of the truck is not used sufficiently effectively and transportation efficiency is very low. What is worse still, loading and unloading operations with a fork lift truck is very troublesome.

SUMMARY OF THE INVENTION

It is a primary object of the invention to provide an improved vibration free container for transportation, which is previously provided with vibration isolating means to absorb vibrations and shocks so as to prevent loaded objects from being damaged and to facilitate packaging of the objects in loading them into the container.

In order to achieve this object, the vibration free container for transportation according to the invention comprises vibration isolating means.

In a preferred embodiment, the vibration isolating means are arranged under the container and comprises a lower layer and an upper layer. The lower layer consists of at least two long laminated rubber bodies in the form of a parallelepiped extending in parallel with each other to isolate horizontal vibrations and the upper layer consists of a plurality of column-shaped vibration isolators for isolating vertical vibrations fixed between a bottom plate of said container and upper surfaces of the laminated rubber bodies.

With this arrangement, as the container, itself, comprises vibration isolating means, cost for packaging can be saved and objects to be transported are effectively guarded by absorbing shocks and reducing vibrations without causing resonance.

It is a further object of the invention to provide a vibration free container for transportation, which comprises vibration isolating members for supporting an inner casing in an outer casing of the container to avoid transmission of vibration to the inner casing accommodating therein objects to be transported and to absorb shocks in transportation, thereby facilitating loading and unloading operations for the objects and improving transporting efficiency with containers.

In order to achieve this object, the container according to the invention comprises an outer casing and an inner casing received in the outer casing, and vibration isolating means is interposed between the outer and inner casing to support the inner casing relative to the outer casing.

With this arrangement, as the inner casing accommodating therein objects to be transported is supported through the vibration isolating means by the outer casing, vibrations and shocks from exterior of the container are absorbed by the vibration isolating means so as not to be transmitted to the inner casing and the objects accommodated therein so that the objects are protected from the vibrations and shocks.

Moreover, as the inner casing is guarded by the outer casing, the container has an appearance similar to those of conventional containers so that the container according to the invention does not interfere with loading and unloading operations although the container includes particular arrangements. Furthermore, when the containers are loaded on a truck or the like, they are able to be settled effectively utilizing a space above a loading platform of the truck and stacked one upon the other so that transportation efficiency can be improved.

In order that the invention may be more clearly understood, preferred embodiments will be described, by way of example, with reference to the accompanying drawings.

DESCRIPTION OF THE PREFERRED EMBODIMENTS

Figure 1:
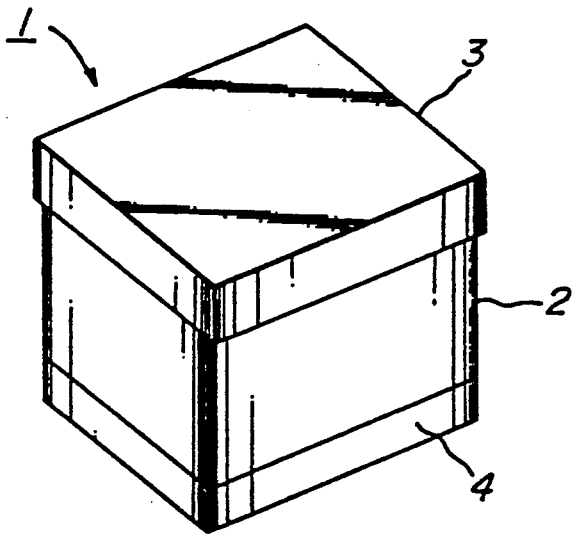
FIG. 1 is a perspective view of a vibration free container of one embodiment according to the invention.

One embodiment of the invention will be explained by referring to FIGS. 1–6. Referring to FIG. 1 which is a perspective view of a vibration free container 1 for transportation of the embodiment according to the invention, the container 1 comprises a lower rectangular casing 2 and an upper cover 3 to form an internal space for accommodating objects.

Figure 2:
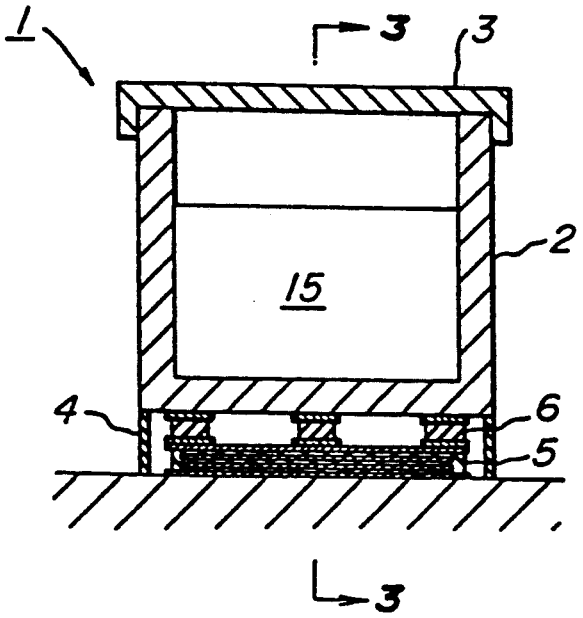
FIG. 2 is a vertical sectional view of the container shown FIG. 1.
Figure 3:
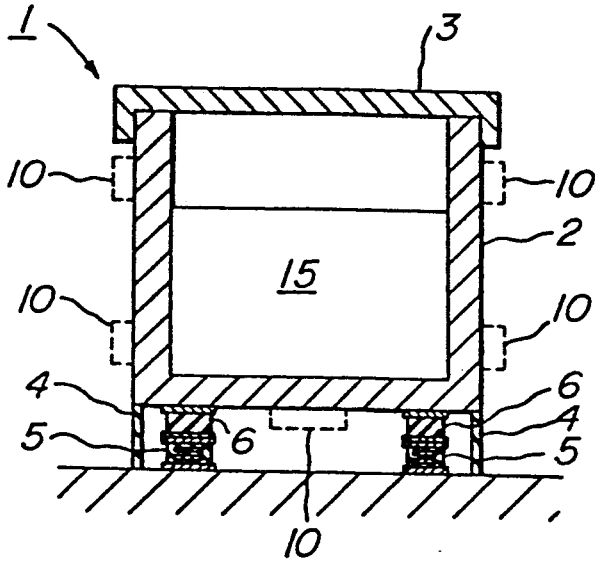
FIG. 3 is a vertical sectional view of the container taken along the line III—III in FIG. 2.

The casing 2 is provided on an underside of its bottom plate with vibration isolating means. Flexible covers 4 extend downward from lower sides of the casing 2 to conceal the vibration isolating means. FIGS. 2 and 3 illustrate the vibration free container 1 in section. Reference numeral 15 denotes objects accommodated in the container 1.

The vibration isolating means arranged under the casing 2 is constructed by two layers one upon the other. The lower layer consists of two long laminated rubber bodies 5 in the form of a parallelepiped extending in parallel with each other to isolate horizontal vibrations. The upper layer consists of a plurality (six in this embodiment) of column-shaped vibration isolators 6 for isolating vertical vibrations fixed between the bottom plate of the casing 2 and upper surfaces of the laminated rubber bodies 5, a plurality (three in this embodiment) of vibration isolators 6 being on each rubber body 5.

The laminated rubber bodies 5 comprise rubber layers and metal plates alternately laminated to mainly eliminate vibrations in horizontal directions. The vibration isolators 6 are rubbers or various springs generally used for isolating vibrations and serve to eliminate vibrations mainly in vertical directions.

Figure 4:
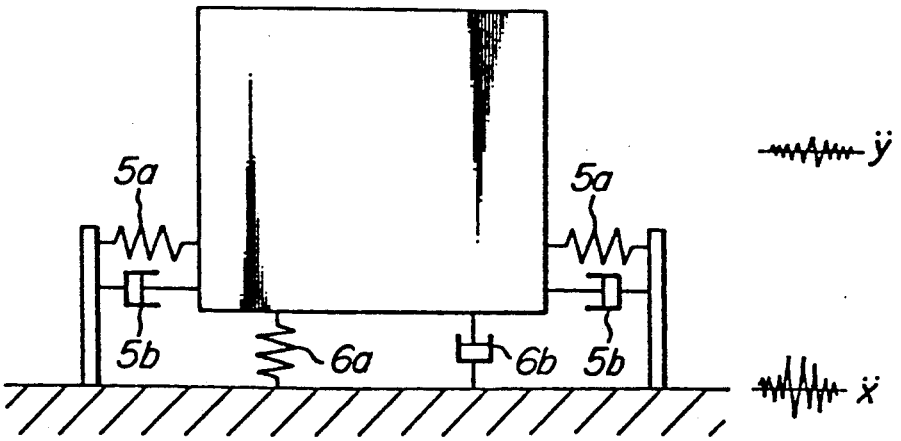
FIG. 4 is a mimic schematic view of the container shown in FIG. 1.

The container according to this embodiment is constructed as above described. FIG. 4 is a schematic view for explaining the operation of the container for isolating the vibrations.

The laminated rubber bodies 5 in the lower layer consist of springs 5*a* horizontally extending and dampers 5*b*. In this manner, the laminated rubber bodies 5 comprise laminated rubbers having soft spring characteristics in horizontal directions to eliminate the vibrations in horizontal directions.

The vibration isolators 6 in the upper layer consist of springs 6*a* vertically extending and dampers 6*b* to eliminate the vibrations in vertical directions.

A vibration test was effected for comparing the vibration free container according to the invention with conventional containers including damping materials but not having any vibration preventing means. Results of the test are shown in FIGS. 5 and 6.

Figure 5:
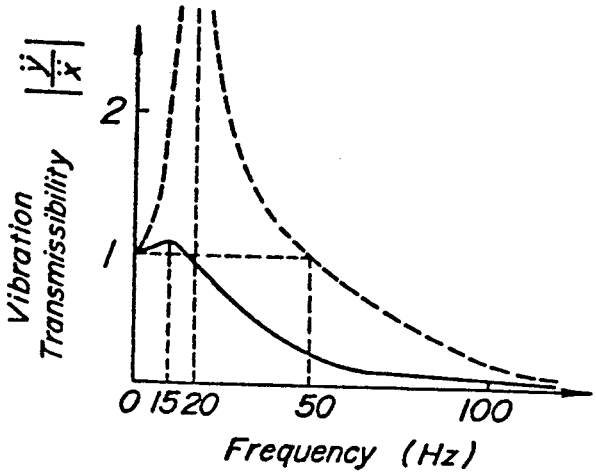
FIG. 5 is a graph illustrating results of vibration transmissibility test of the container shown in FIG. 1.
Figure 6:
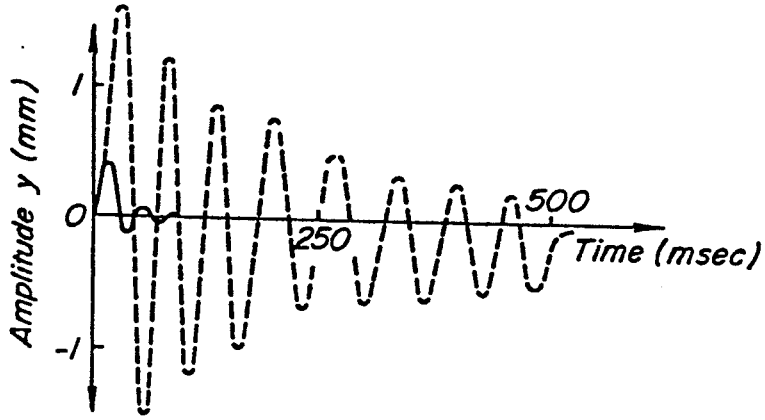
FIG. 6 illustrates damping characteristics in shock test of the container shown in FIG. 1.

FIG. 5 illustrates vibrations of the container bodies (vibration acceleration $\ddot{y}$) as vibration transmissibility ($|\ddot{y}/\ddot{x}|$) when vibrations (vibration acceleration $\ddot{x}$, of a floor in vertical directions are applied to the containers. An abscissa and an ordinate in FIG. 5 indicate frequencies of the vibrating floor and the vibration transmissibility, respectively. The results of the vibration free containers according to the invention are shown in a solid line and the results of the container of the prior art are in broken lines.

The containers of the prior art generally have a resonance frequency of about 20 Hz and exhibit very large vibration transmissibility at frequencies slightly less or more than the resonance frequency. They exhibit vibration transmissibility less than 1 only with vibrations whose frequencies are more than 50 Hz. With vibrations of frequencies less than 50 Hz, the vibrations are either directly or under more enhanced conditions transmitted to the container bodies of the prior art.

In contrast herewith, with the vibration free containers according to the invention, vibration transmissibility only slightly exceeds 1 even in the proximity of the resonance frequency and are completely less than 1 over all frequencies with exception of the proximity of the resonance frequency. In the frequency zone more than 50 Hz, particularly, the vibration transmissibility is very small. It is clearly evident that the vibration isolating effect can be obtained with very high performance according to the invention FIG. 6 illustrates response waveforms (damping characteristics) in relation to time when impacts are applied in vertical directions, waveforms of the vibration free contains 1 according to the invention in a solid line and those of the conventional containers in a broken line. As can be seen from these results, amplitudes of the containers according to the invention are much smaller than those of the conventional containers and could be damped in a very short period of time.

Although the above test is effected with vibrations and impacts in vertical directions, similar results are obtained with vibrations and impacts in horizontal directions to exhibit the great vibration isolating effect.

Referring to FIG. 3 illustrating another embodiment of the invention, dynamic dampers 10 may be fixed to side plates and an underside of a bottom plate of a casing of a container. A vibration absorbing effect arises with this arrangement to produce a larger vibration isolating effect.

Figure 7:
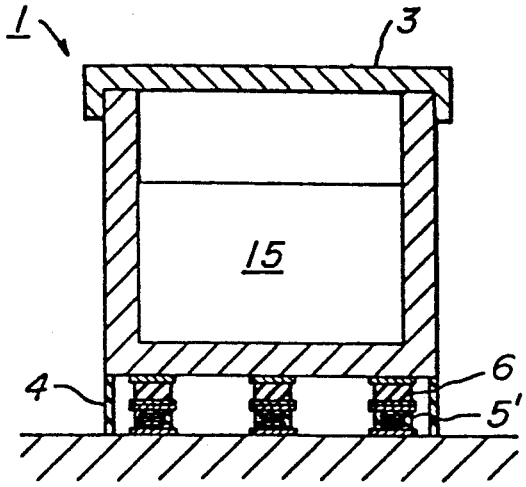
FIG. 7 is a vertical sectional view of a vibration free container of another embodiment of the invention.

Although the lower layers of the vibration isolating means are laminated rubber bodies in the form of the parallelepiped in the above embodiments, the lower layers may consist of a plurality of laminated rubber bodies 5′ corresponding to the vibration isolators 6 in the upper layers as shown in FIG. 7. In this embodiment, the laminated rubber bodies 5′ are also column-shaped corresponding to the vibration isolators 6 and comprise rubber layers and metal plates alternately laminated.

Figure 8:
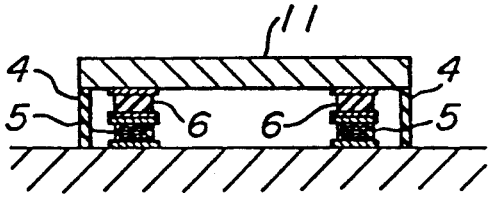
FIG. 8 is a vertical sectional view of a vibration free container as a pallet according to the invention.

Moreover, the vibration isolating means used in the present invention may be similarly applicable to a pallet consisting of only a bottom plate without providing with side plates of a container body as shown in FIG. 8.

Furthermore, covers concealing a space under a container may be partially notched to permit a fork of a fork lift truck to be inserted between the vibration isolating members when the container is set on a flat surface so as to facilitate transferring and loading operations of the container.

Figure 9:
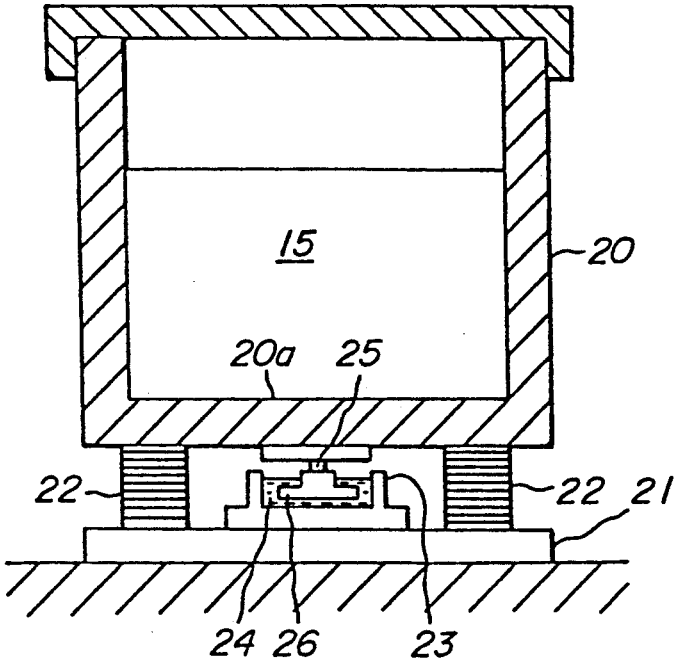
FIG. 9 is a vertical sectional view of a vibration free container of a further embodiment according to the invention.

The vibration isolating means utilizes the laminated rubber bodies and the vibration isolators to have a constant damping coefficient in the above embodiments. It is, however, possible for the vibration isolating means to have a variable damping coefficient. FIG. 9 illustrates one example having such a damping coefficient.

The container shown in FIG. 9 comprises a container body 20 and a base plate 21 below a bottom plate 20*a* of the container body 20. Four column-shaped laminated rubber bodies 22 are interposed at four corners between the bottom plate 20*a* and the base plate 21, upper and lower surfaces of the laminated rubber bodies 22 being fixed to the bottom plate 20*a* and the base plates 21, respectively.

Onto an upper surface of the base plate at its center is fixed a cylindrical vessel 23 in which an ER fluid 24 is filled. A variable resistance plate 26 in the form of a disk is hung above the vessel 23 from an underside of the bottom pate 20*a* of the container body 20 through a support rod 25.

A viscous drag of the ER fluid 24 is instantaneously varied by changing applied voltages. The ER fluid has a low viscosity and flowable like water when voltage is not applied to the fluid. However, as the voltage to be applied to the fluid is progressively increased, the viscosity of the fluid also increases to solidify step by step. This variation of the fluid is reversible and superior in response.

Therefore, by controlling the voltage to be applied to the fluid, the viscosity or damping coefficient of the fluid can be freely varied. For this purpose, the container may be provided with a control system including a vibration sensing system, a microcomputer, variable DC source and the like.

The vibration sensing system detects vibrations of the container body relative to the base plate 21 to output detected values to the microcomputer. The microcomputer calculates the voltage to apply to the fluid on the basis of vibrations applied to the container in order to obtain a suitable viscous coefficient and outputs a command signal to the variable DC source. The variable DC source supplies the voltage determined by the command signal to the ER fluid 24 through the housing 23 and the variable resistance plate 26.

With this control system, as it is possible to change the viscous coefficient of the fluid or the dynamic characteristics of the dampers 5*b* and 6*b* in FIG. 4 on the basis of vibrations, various damping characteristics of the vibration isolating means are obtained. Accordingly, the optimum vibration control can be effected in consideration of used conditions according to the invention.

An algorithm (software) for the control is usually stored in an ROM, so that the damping characteristics of containers can be changed by simply replacing the ROM with another one. It is therefore possible to enable the container itself to have various uses.

For example, it is required for the container to have a superior transitional responsibility particularly to shocks in addition to the responsibility to steady vibration, such a requirement is fulfilled by using a ROM selected so as to meet the requirement. Moreover, in order to obtain particular characteristics of a container, new software for the container may be manufactured to meet the requirement.

Furthermore, the characteristics of the vibration preventing means may be varied by the use of actuators such as small type motors and the like other than the above method by controlling the voltage to be applied to the ER fluid.

Moreover, in order to obtain various characteristics of vibration isolating means, spring components in vertical and horizontal directions as shown by 6*a* and 5*a* a in FIG. 4 may be made variable. Therefore, for this purpose, the spring components may be controlled by computers to obtain optimum characteristics according to vibrations acting upon the container.

Figure 10:
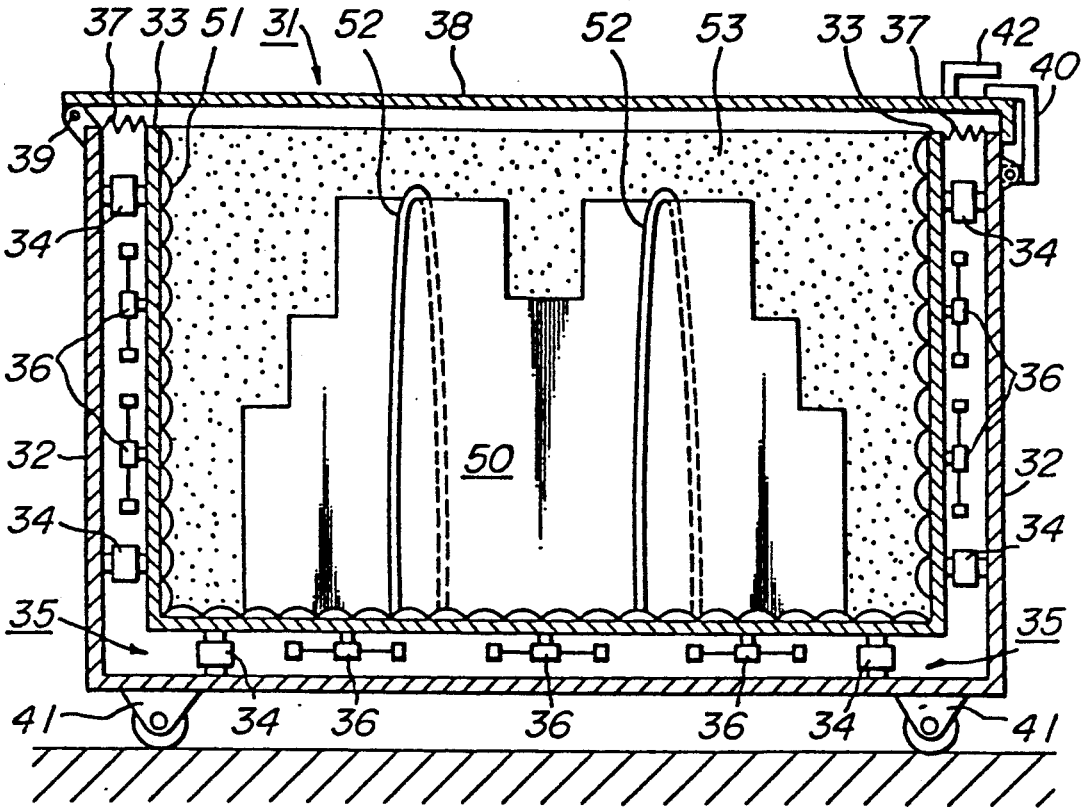
FIG. 10 is a vertical sectional view of one embodiment according to the invention.

A further embodiment of the invention will be explaining to FIGS. 10–14. FIG. 10 is a sectional view of a vibration free container 31 for transportation according to this embodiment.

The container 31 is of a double construction consisting of an outer casing 32 in the form of a parallelepiped and an inner casing 33 which is smaller than the outer casing and in the form of a parallelepiped similar to the outer casing and is supported by the outer casing 32 through vibration isolators 34 as vibration preventing members.

The vibration preventing rubbers 34 are arranged at plural locations in clearances 35 between the outer and inner casings 32 and 33. The vibration isolators 34 are arranged at four corners and other suitable locations between bottom plates of the outer and inner casing 32 and 33 to support the weight of the inner casing 33. The other vibration isolators 34 are arranged at suitable locations between side plates of the outer and inner casings 32 and 33.

Other vibration isolating means may be used, for example, metal springs and elastomers such as polyurethane foam.

A plurality of dynamic vibration absorbing means 36 are fixed at suitable positions to outer surfaces of the inner casing 33 in the clearances 35 between the outer and inner casings 32 and 33.

There are provided bellows elastomers 37 extending in clearances between upper ends of the outer and inner casings 32 and 33 to prevent foreign objects from entering the clearances.

An upper cover 38 for covering an upper opening of the container is pivotally connected to an upper edge of the outer casing 32 by means of a rotary hinge 39. When the container is closed by the upper cover 38, the upper cover 38 is locked thereto by means of a buckle 40 fixed to the other upper edge of the outer casing 32.

Retracting casters 41 are provided at four locations at corners of an underside of the bottom plate of the outer casing 32. The retracting casters 41 are able to be housed in the clearance 5 between the outer and inner casing 2 and 3 by pulling a lever 12 arranged at an above position, if required.

The housing mechanism for retracting the caster 41 into the clearance will be explained by referring to FIG. 11. The caster 41 comprises a support plate 43 in the form of a triangle and a wheel 44 rotatably supported by the support plate 43 at its one corner. The other corner of the support plate 43 is journaled by a support shaft 45 fixed to the outer casing 32 so that the support plate 13 is rotatably supported together with the wheel 44 by the outer casing 32.

A remaining corner of the support plate 43 is formed with a circular aperture (two apertures in actual case because the support plate 43 comprising two integral parallel triangular plates). When the circular aperture is brought into alignment with a further circular aperture formed in the outer casing 32 at a predetermined position, a support rod 46 is inserted into both the circular apertures to hold the caster at a position shown in solid lines in FIG. 11 so as to support the container 41 by the extending wheel 54. One end of a rope or wire 47 is fixed to the proximity of the circular aperture of the support plate. The rope or wire 47 extends upwards and its other end is once bent at a location not shown in a horizontal direction and fixed to the lever 42.

All the casters 41 are constructed as above described and the ropes or wires 47 extend in the clearances 5 between the outer and inner casings 32 and 33.

With the casters 41 extending out of the container, it can be easily moved on a floor by means of the wheels 44 of the casters 41. Moreover, since there is a clearance between the floor and the bottom plate of the outer casing, it is possible to insert a handler (fork) of a fork lift truck into the clearance to raise the container.

Figure 11:
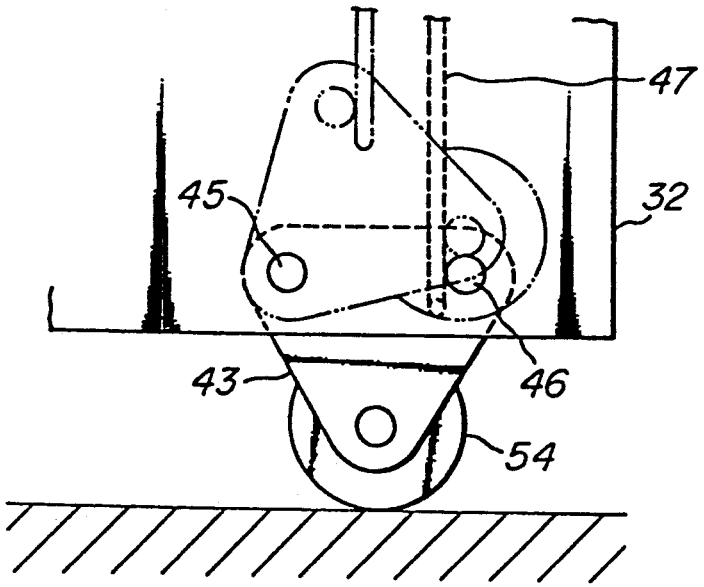
FIG. 11 is an explanatory view of a caster used in the container according to the invention.

With the container being raised, the support rods 46 are removed from the casters 41 and the levers 42 are pulled to retract the casters between the outer and inner casings 32 and 33 as shown in broken lines in FIG. 11. A number of containers can be stacked one upon the other in this manner.

Buffer members or shock absorbing members 51 are arranged on inner surfaces of the inner casing 33. A load 50 is fixed to the bottom plate of the inner casing 33 by means of support means 22. Buffer members are filled in the remaining space in the inner casing 33 to avoid vibrations and shocks.

Figure 12:
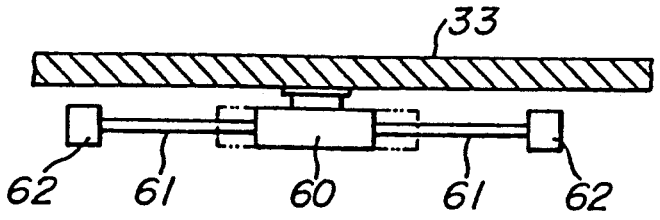
FIG. 12 is a side view of dynamic damper used in the container according to the invention.

FIG. 12 illustrates on an enlarged scale the dynamic vibration absorbing means (dynamic damper) 36 fixed to the outer surface of the inner casing 33. The vibration absorbing means 36 comprises a support block 60 fixed to the outside of the inner casing 33, levers 61 extending in opposite directions from the support block 60 in parallel with the outer surface of the inner casing 33, and weights 62 supported by free ends of the levers 61. The weights 62 are vibrated by the levers 61 serving as springs to absorb vibrations of the inner casing 33.

As shown in phantom lines in FIG. 12, the support block 60 is elongated toward both of the levers 61 to change supporting points for the levers 61 and lengths of the levers 61, thereby adjusting the spring constant of the dynamic vibration absorbing means.

Moreover, the spring constant of the dynamic vibration absorbing means may be varied by changing lengths of the levers 31, themselves, or positions of the weights mounted on the levers 31.

Figure 13:
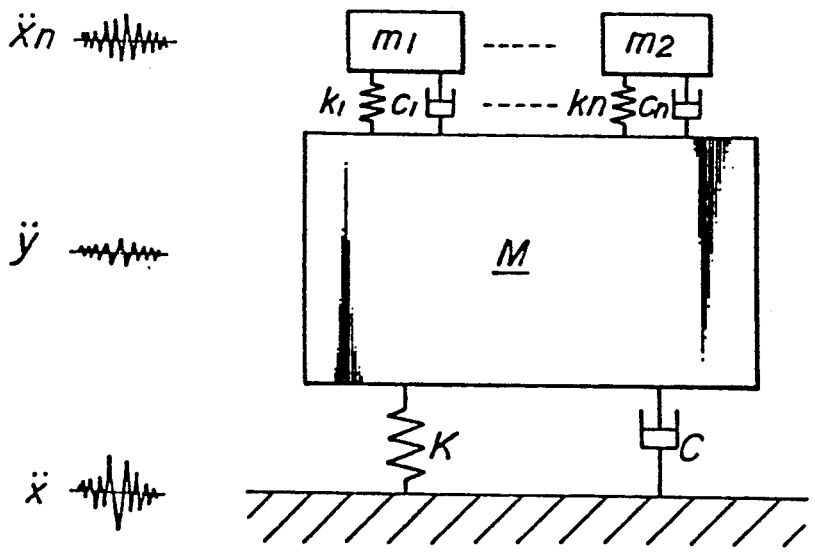
FIG. 13 is a schematic view of the container shown in FIG. 12.

The vibration free container according to this embodiment is constructed as above described. FIG. 13 schematically illustrates the vibration isolating mechanism according to the invention.

The vibration isolator 34 consists of a spring having a spring constant K, and a damper whose damping coefficient is c. The sum of masses of the inner casing 33 and the load 20 is M. Masses of the weights 62, spring constants of the levers 61 and damping coefficients of the levers are indicated by $(m_1, k_1, c_1), (m_2, k_2, c_2) \ldots, (m_n, k_n, c_n)$.

The vibrations (accelerations) $\ddot{x}$ from the floor are damped by the spring constant k and the damping coefficient through the vibration isolators 64 and transmitted to the inner casing 63. In this case, with the aid of the dynamic vibration absorbing means whose spring constant is suitably adjusted, the vibration xn of the weight 62 absorbs vibration $\ddot{y}$ of the inner casing 63 to eliminate the vibration of the inner casing 63.

Figure 14:
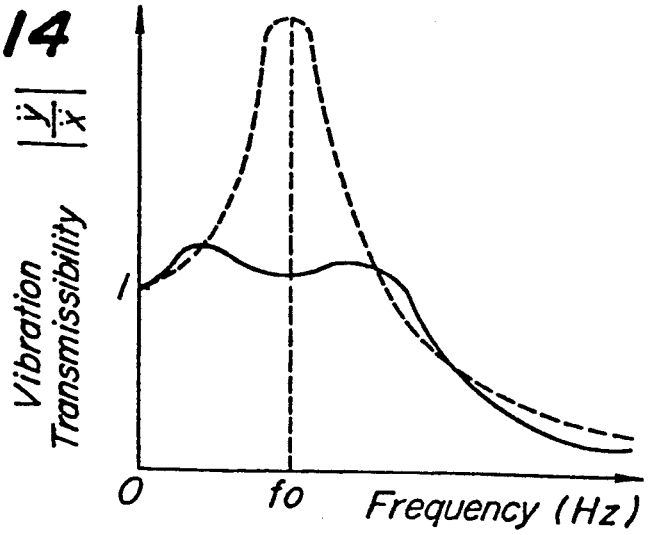
FIG. 14 illustrates results of vibration transmissibility test.

FIG. 14 illustrates vibrations of the inner casing 33 (vibration accelerations $\ddot{y}$) as vibration transmissibility ($|y/x|$) when vibrations (vibration accelerations $\ddot{x}$) of a floor in vertical directions are applied to the containers. An abscissa and an ordinate in FIG. 5 indicate frequency and the vibration transmissibility, respectively. The results of the vibration free containers according to the invention are shown in a solid line and the results of the container of the prior art are in a broken line.

With the containers of the prior art, there is no vibration isolating means other than that the loads therein are held by supporting means and buffer members are filled in inner spaces of the containers. Therefore, the containers of the prior art have resonance frequencies $f_0$ at certain frequencies and the loads undergo violent vibrations at the frequencies $f_0$.

In contrast herewith, according to the invention the spring constant of the dynamic vibration absorbing means 6 is so adjusted that the vibrations at the resonance frequencies $F_0$ are eliminated, so that the vibration transmissibility at the resonance frequency can be greatly reduced as shown in the solid line. Although there are only two peaks of the vibration transmissibility in slight excess of 1 at frequencies slightly less than and slightly more than the resonance frequency $F_0$, the containers according to the embodiment clearly exhibit the significant vibration isolating effect.

The response waveforms (damping characteristics) were investigated in relation to time when impacts are applied in vertical directions. Results were obtained which were quite similar to those shown in FIG. 6. As can be seen from the results, amplitudes of the containers according to the invention are much smaller than those of the conventional containers and could be damped in a very short period of time.

Although the above test is effected with vibrations and impacts in vertical directions, the similar results are obtained with vibrations and impacts in horizontal directions to exhibit the great vibration preventing effect.

The vibration free containers according to the embodiment eliminate all vibrations and absorb impacts by mitigating the vibrations at the resonance frequencies.

Moreover, the outer casing 32 is provided with retractable casters 41 to make easy the horizontal movements of the container 31 and the lifting of the container by a fork lift truck, thereby improving the efficiency of loading and unloading operations.

Furthermore, as the casters 41 are able to be housed in the outer casing 32, containers can be stacked one above the other. A space on a loading platform of a truck can be utilized with high efficiency to a maximum possible extent without being affected by the configuration of loads, thereby improving transportation efficiency.

Figure 15:
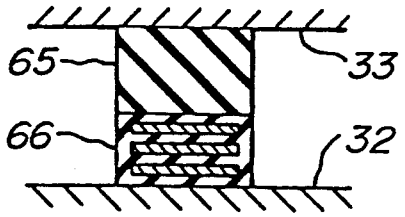
FIG. 15 is a sectional view of a vibration isolating member used in the container shown in FIG. 10.

Although the inner casing 33 is supported by vibration preventing rubbers, two layer rubbers may be used, each consisting of an upper layer vibration isolator 65 and a lower layer laminated rubber body 66 as shown in FIG. 15. The lower layer 66 comprises rubber layers and metal plates alternately laminated to eliminate vibrations mainly in horizontal directions. The two layer rubbers used herein may be provided on outer surfaces of the inner casing 33 in addition to those provided between bottom plates of the outer and inner casings, thereby eliminating vibrations of the inner casing in vertical directions.

Figure 16:
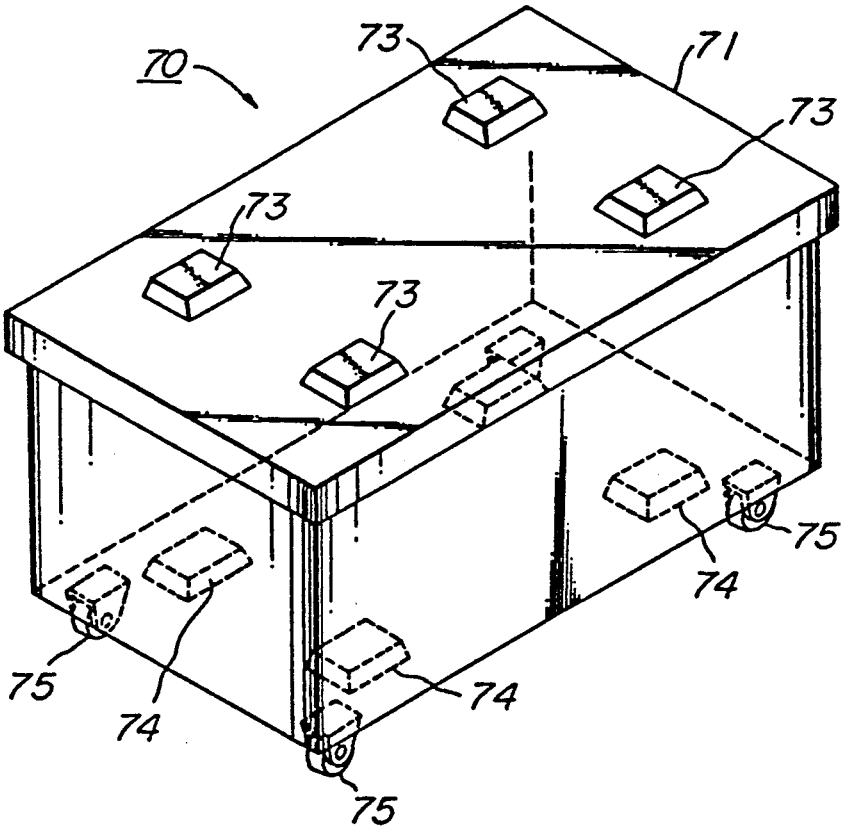
FIG. 16 is a perspective view of a vibration free container of a further embodiment of the invention.

Referring to FIG. 16, an upper cover 71 of a vibration free container 70 is provided with protrusions 73 at suitable positions on an upper surface of the upper cover 71, while a bottom plate of an outer casing 72 provided on an underside thereof with recesses 74 at positions corresponding to those of the protrusions 73 on the upper cover 71. When the containers 70 having casters housed therein are stacked one above the other, the protrusions 43 on the upper cover 71 of one container are fitted in the recesses in the bottom plate of the other container 70 immediately above the one container, so that these containers are fixed with each other to prevent any relative horizontal movements.

As can be seen from the above explanation, the container itself is provided with vibration isolating means according to the invention, so that packaging operations required for goods particularly susceptible to vibrations are considerably reduced. Moreover, the container according to the invention effectively absorbs shocks and prevents resonance with vibrations to suppress the vibration transmissibility, thereby achieving the effective vibration isolating effect. The container according to the invention exhibits the great effect particularly in transporting precise machines and instruments delicate to vibrations and shocks.

Moreover, according to the invention the inner casing for receiving a load is supported by the outer casing through the vibration isolating members, so that vibrations and shocks from exterior are absorbed by the vibration isolating members and not transmitted to the inner casing and the load, thereby protecting the load from vibrations.

An external appearance of the container according to the invention is similar to those of conventional containers so that loading and unloading operations are not interfered with the vibration isolating means provided on the container. In the event that the vibration free containers are loaded on vehicles for transportation, spaces on loading platforms of the vehicles are effectively utilized. The containers according to the invention can be stacked one upon the other so that transportation efficiency can be improved.

It is further understood by those skilled in the art that the foregoing description is that of preferred embodiments of the disclosed containers and that various changes and modifications may be made in the invention without departing from the spirit and scope thereof.

What is claimed is:

1. A vibration free pallet for transportation, comprising:

a bottom plate;

vibration isolating means arranged under said bottom plate, and comprising first and second vibration isolating devices disposed one on top of another, said first vibration isolating device eliminating vibration mainly in a vertical direction and comprising vibration isolators fixed to said bottom plate, and second vibration isolating device eliminating vibration mainly in a horizontal direction and comprising laminated rubber bodies fixed to and corresponding in number and sectional shape to said vibration isolators of said first vibration device; and a dynamic damper fixed to an underside of said bottom plate.

2. A vibration free pallet as claimed in claim 1, wherein each of said laminated rubber bodies comprises rubber layers and metal plates alternately laminated.

3. A vibration free pallet for transportation, comprising:

a bottom plate;

vibration isolating means arranged under said bottom plate, and comprising first and second vibration isolating devices disposed one on top of another, said first vibration isolating device eliminating vibration mainly in a vertical direction, and said second vibration isolating device eliminating vibration mainly in a horizontal direction; and a dynamic damper fixed to an underside of said bottom plate, wherein said second vibration isolating device comprises at least two long laminated rubber bodies in the form of a parallelepiped extending parallel to each other, and said first vibration isolating device comprises a plurality of column-shaped vibration isolators fixed between said bottom plate and upper surfaces of laminated rubber bodies.

4. A vibration free pallet as claimed in claim 3, wherein each of said laminated rubber bodies comprises rubber layers and metal plates alternately laminated.

5. A vibration free pallet for transportation, comprising:

a bottom plate;

vibration isolating means arranged under said bottom plate, and comprising first and second vibration isolating devices disposed one on top of another, said first vibration isolating device eliminating vibration mainly in a vertical direction and comprising vibration isolators fixed to said bottom plate, and said second vibration isolating device eliminating vibration mainly in a horizontal direction and comprising laminated rubber bodies fixed to and corresponding in number and sectional shape to said vibration isolators of said first vibration device;

side plates connected to said bottom plate; and dynamic dampers fixed to said side plates and to an underside of said bottom plate.

6. A vibration free pallet for transportation, comprising:

a bottom plate;

vibration isolating means arranged under said bottom plate, and comprising first and second vibration isolating devices disposed one on top of another, said first vibration isolating device eliminating vibration mainly in a vertical direction, and said second vibration isolating device eliminating vibration mainly in a horizontal direction; and a dynamic damper fixed to an underside of said bottom plate, wherein said vibration isolating means comprises a base plate below the bottom plate, said second vibration isolating device comprises a plurality of column-shaped laminated rubber bodies whose upper and lower surfaces are fixed to said bottom plate and said base plate, respectively, and wherein said first vibration isolating device comprises a vessel located on said base plate receiving an ER fluid therein, a variable resistance plate hung from the bottom plate into the ER fluid, and control means for controlling viscous drag of the ER fluid.

7. A vibration free pallet for transportation, comprising:

a bottom plate;

vibration isolating means arranged under said bottom plate, and comprising first and second vibration isolating devices, said first vibration isolating device eliminating vibration mainly in a vertical direction, and said second vibration isolating device eliminating vibration mainly in a horizontal direction, said second vibration isolating device comprising a plurality of laminated rubber bodies; and a dynamic camper fixed to an underside of said bottom plate, wherein said first vibration isolating device comprises variable damping means, provided parallel to said laminated rubber bodies, for providing a variable damping capacity, said variable damping means comprising a base plate below the bottom plate, a piston disposed on a bottom side of said bottom plate, a cylinder on said base plate, and an ER fluid disposed within said cylinder, said piston being hung into the ER fluid, said laminated rubber bodies being fixed between the bottom plate and the base plate.

* * * * *